US005564289A

United States Patent [19]

Hino

[11] Patent Number: 5,564,289

[45] Date of Patent: Oct. 15, 1996

[54] DIRECT-CONTACT TYPE COOLING TANK WITH UPWARD REFRIGERANT PASSAGE

[75] Inventor: Toshiyuki Hino, Chohu, Japan

[73] Assignee: Kajima Corporation, Tokyo, Japan

[21] Appl. No.: 407,649

[22] Filed: Mar. 21, 1995

[30] Foreign Application Priority Data

Apr. 18, 1994 [JP] Japan ..... 6-079040

[51] Int. Cl.[6] ..... C02F 1/22

[52] U.S. Cl. ..... 62/534; 62/541; 62/389; 62/74; 252/67

[58] Field of Search ..... 62/59, 533, 534, 62/535, 536, 541, 123, 74, 330, 389, 502, 114, 66; 252/67

[56] References Cited

U.S. PATENT DOCUMENTS 4,509,344 4/1985 Ludwigsen et al. ..... 62/541
4,596,120 6/1986 Knodel et al. ..... 62/534
5,218,828 6/1993 Hino .

FOREIGN PATENT DOCUMENTS 5-75948 10/1993 Japan .

*Primary Examiner*—John M. Sollecito
*Attorney, Agent, or Firm*—Oblon, Spivak, McClelland, Maier & Neustadt, P.C.

[57] ABSTRACT

A cooling tank 1 for cooling water 2*b* by bringing water 2*b* in direct contact with hardly-water-soluble refrigerant 2*c* having a larger specific gravity than that of water, which tank 1 has an inside space 3 above water surface in the tank 1 and the pressure $P_t$ of the space 3 is kept below the saturation pressure $P_0$ of the refrigerant 2*c* at water freezing point ($P_t \leqq P_0$). The tank 1 also has a refrigerant extraction hole 6*a* for extracting gas-phase refrigerant 2*c*, an outlet 14*a* for drawing cooled water 2*b*, and an upward passage 30 for refrigerant extending from the bottom of the tank 1 to the water surface therein, which passage 30 guides ascension of that refrigerant 2*c* which settles at the tank bottom toward the space 3 above the water surface.

10 Claims, 7 Drawing Sheets

DIRECT-CONTACT TYPE COOLING TANK WITH UPWARD REFRIGERANT PASSAGE

BACKGROUND OF THE INVENTION

1. Field of the Invention

This invention relates to a direct-contact type cooling tank with upward refrigerant passage. In particular, the invention relates to a cooling tank for cooling water by bringing water in direct contact with hardly-water-soluble refrigerant having a larger specific gravity than that of water.

2. Description of the Prior Art

Research and development effort has been made on direct-contact type freezing cycle in which water is brought in direct contact with liquid of hardly-water-soluble refrigerant (including water insoluble refrigerant, to be referred to as "refrigerant" hereinafter) and the refrigerant is evaporated so as to cool water and to make ice. When such direct-contact type freezing cycle is applied to heat-storage type air cooling, considerable cost cut down is possible as compared with both conventional chillers and ice-making machines because refrigerant evaporators can be eliminated from chillers and freezing heat-exchangers can be eliminated from the ice-making machines.

The inventor disclosed his inventions relating to method and apparatus for storing heat in ice by using refrigerant jet in Japanese Patent Laying-open Publications No. 313657/1992 and No. 280842/1993. To facilitate the understanding of this invention, the method of the above Japanese Patent Laying-open Publication No. 313657/1992 will be briefly reviewed by referring to FIG. 7. The use of the cooling tank of this invention, however, is not limited to such method. With a water tank 1*a* of heat insulating construction, the pressure $P_t$ of the space 3 above water surface in the tank 1*a* is kept below the saturation pressure $P_0$ of hardly-water-soluble refrigerant 2*c* at 0° C. ($P_t \leqq P_0$).

A mixer 4 mixes liquid-phase refrigerant 2*c* from a refrigerant liquid pipe 10 with water 2*b* from a cooling water return pipe 18 at a pressure $P_1$ which is higher than the above saturation pressure $P_0$ ($P_1 \geqq P_0$). The liquid mixture of refrigerant 2*c* and water 2*b* is jetted through a nozzle 5 into the space 3 above the water surface.

Since water 2*b* is mixed with refrigerant 2*c* at the pressure $P_1$ which is higher than the saturation pressure $P_0$ of refrigerant 2*c*, water 2*b* does not freeze in the mixer 4, and the liquid mixture is jetted in liquid phase, so that refrigerant 2*c* evaporates in the space 3 above the water surface to produce ice 2*a*. As the liquid mixture is scattered in liquid phase, ice 2*a* can be dispersed over a wide area, and a heat exchange occurs very efficiently. Refrigerant which has evaporated in the space 3 in the tank 1*a* is extracted through a refrigerant gas outlet pipe 6 by a compressor 7, and after being liquefied, refrigerant 2*c* returns to the mixer 4. After being cooled by ice 2*a* and evaporation of refrigerant 2*c*, water 2*b* in the tank 1*a* is drawn through a cooling water outlet pipe 14 by a circulating pump 15, so as to pass through a heat exchanger 16 and return to the mixer 4. In the heat exchanger 16, cold water 2*b* provides cold heat to the piping 17 of an air conditioner 20. In the figure, a check valve 10*a* prevents water 2*b* from entering into the refrigerant liquid pipe 10 when the compressor 7 is at rest.

The inventor succeeded in using fluoropentanes as a refrigerant in the process of direct-contact type ice making, and disclosed such use in Japanese Patent Laying-open Publication No. 033046/1994. Heretofore, Freon (Trademark of Du Pont de Nemours & Co.) and hydrocarbons have been used as refrigerants for direct-contact type ice making. Freon has shortcoming in that it may cause depletion of ozone layer in stratosphere, and hydrocarbons such as pentane have shortcoming of being easily inflammable and require special fire-protective precautions. Perfluoropentane and other fluorinated pentanes such as fluorohydropentanes fulfill substantially all requirements for refrigerant of direct-contact type ice making, because they are free from the above shortcomings and have numerous advantageous points; namely, requiring no pressure-resisting tank for heat storage, being harmless, being incombustible, being free from reaction with water, and so on.

SUMMARY OF THE INVENTION

Of the above-referred fluorinated pentanes, if those which have a larger specific gravity than that of water are used as a refrigerant 2*c* in the heat storing apparatus of FIG. 7, liquid-phase portion of such refrigerant 2*c* that did not evaporate in the space 3 above water surface after being jetted tends to settle at the bottom of the water tank 1*a*. As long as the liquid-phase refrigerant 2*c* stays on top of the surface layer of ice 2*a* in the tank 1*a*, it may evaporate sooner or later. The surface layer and lower layers of ice 2*a* made by the direct-contact type ice making, however, are sherbet-like and porous, and refrigerant 2*c* may pass between particles of ice 2*a* and may settle at the bottom of the tank 1*a*. If a part of refrigerant 2*c* fails to evaporate and becomes settled in the tank 1*a*, the amount of active refrigerant 2*c* circulating in the refrigerative cycle gradually decreases, and the pressure of evaporation may be reduced, leading to a reduction of the refrigerating capacity and deterioration of the coefficient of performance.

Further, in the case of using the water tank 1*a* of FIG. 7 for heat storage, the settled liquid-phase refrigerant 2*c* is drawn together with cooled water 2*b* by the circulating pump 15. If the refrigerant 2*c* is discharged from the circulating pump 15 and returns to the nozzle 5, it may be jetted and sprayed again into the space 3 above water surface, and it is expected to return to the refrigerative cycle. Liquid-phase refrigerant 2*c*, however, is easily gasified at low-pressure portions of the circulating pump 15, causing the so-called cavitation phenomenon. Once cavitation occurs, water discharge capacity of the circulating pump 15 is reduced, and noisy vibration is caused, and in an extreme case the circulating pump 15 may be broken. When the tank 1*a* is tall and cooled water 2*b* in the tank 1*a* is very deep, the static water pressure becomes high enough to substantially suppress the occurrence of cavitation. If the water depth in the tank 1*a* is about 2 m, however, it has been experienced that circulating pump 15 of conventional centrifugal type is easily susceptible to serious cavitation which leads to interruption of water discharge from the circulating pump 15.

Therefore, an object of the present invention is to provide a direct-contact type cooling tank with upward refrigerant passage for recovering the refrigerant settling at the tank bottom and for returning such refrigerant to the refrigerative cycle.

Referring to FIG. 1, in an embodiment of the direct-contact type cooling tank with upward refrigerant passage according to the invention, water 2*b* is cooled in the cooling tank 1 of heat-insulating construction by bringing it in direct contact with hardly-water-soluble refrigerant 2*c* having a larger specific gravity than that of water. Inside space 3 above water surface in the tank 1 is kept at a pressure $P_t$ below the saturation pressure $P_0$ of the refrigerant 2*c* at water freezing point ($P_t \leqq P_0$), and the tank 1 has a refrigerant extraction hole 6*a* for extracting gas-phase refrigerant 2*c* and an outlet 14*a* for drawing cooled water 2*b*. Further, an upward passage 30 for refrigerant 2*c* extends from the bottom of the tank 1 to the water surface therein, which passage 30 guides ascension of that refrigerant 2*c* which settles at the bottom of the tank 1 to the space 3 above the water surface.

Preferably, the upward passage 30 is defined by an upright pipe 31 which has a lower end opening facing the bottom of the tank 1 and a top end opening located in the vicinity of water surface in the tank 1. More preferably, a cone-like expanded portion 32, as shown in FIG. 2, is formed at the lower end of the upright pipe 31 by gradually expanding the lower end portion of the upright pipe 31 as it extends toward the bottom of the tank 1.

The upward passage 30 of FIG. 1, which is defined as the inside passage of the upright pipe 31, extends through the central portion of the tank 1, but such upward passage 30 may be provided at any other suitable portion of the tank 1, for instance along its peripheral wall. Although the upper end of the upright pipe 31, namely, that of the upward passage 30, in the embodiment of FIG. 1 reaches above the water surface in the tank 1, it does not matter in the invention whether the upper end opening of the upright pipe 31 is located below or above the water surface, provided that the upper end of the pipe 31 opens in the vicinity of the water surface where static water pressure is nil or very small.

Functions of the cooling tank 1 of FIG. 1 will now be described by referring to a case of using normal perfluoropentane ($nC_5F_{12}$) as the refrigerant 2*c*. It should be noted, however, that other hardly-water-soluble refrigerants 2*c*, such as Freons (CFC, HCFC, HFC), fluorinated pentanes (FC, $F_4C_{10}$, $F_6C_{14}$, and the like), other perfluoropentanes and/or fluorohydropentanes, can be used with the cooling tank 1 of the invention, provided that the refrigerants 2*c* have a larger specific gravity than that of water.

Due to static water pressure at the bottom of the cooling tank 1, it is difficult for liquid-phase refrigerant 2*c* settling at the bottom of the cooling tank 1 to boil. For instance, in the case of a 1.5 m deep cooling tank 1, the refrigerant 2*c* at its bottom is subjected to static water pressure of about 15 kPa. In the example of FIG. 1, to initiate the boiling of the settled refrigerant 2*c* at the tank bottom, the pressure at the space 3 above water surface may be reduced by an amount sufficient for overcoming the above static water pressure at the tank bottom. If the temperature at the bottom of the 1.5 m deep cooling tank 1 is 1° C., the saturation pressure of normal perfluoropentane ($nC_5F_{12}$) at that temperature is 29 kPa, and reduction of the pressure at the space 3 to 14(=29−15) kP or below will cause the settled refrigerant 2*c* to start boiling.

Refrigerant gas generated by such boiling ascends to the space 3 through the upward passage 30. Once refrigerant 2*c* starts boiling, an uprising stream is generated in the upward passage 30 by buoyancy of refrigerant 2*c*, and the apparent specific gravity of water in the upward passage 30 is reduced to lower the static water pressure in the upward passage 30. If the void ratio in the passage 30 is, for instance, 50%, the static water pressure in the above example may be lowered to 7.5 kP. The above uprising stream also produces fluid flows toward the lower end opening of the upward passage 30 at the bottom of the cooling tank 1, and a kind of drawing action is generated by which non-boiling liquid refrigerant 2*c* is drawn to the upward passage 30. The liquid refrigerant 2*c* thus drawn starts boiling in the upward passage 30. Thus, once an uprising stream is generated in the upward passage 30, the above drawing action accelerates not only the ascension of the settled refrigerant 2*c* but also its boiling. After reaching the space 3 above water surface, gas phase refrigerant 2*c* returns to the refrigerative cycle through the refrigerant extraction hole 6*a*.

Thus, the above-mentioned object of the invention is fulfilled by facilitating not only recovery of the refrigerant settling at the tank bottom but also return of such refrigerant back to the refrigerative cycle.

BRIEF DESCRIPTION OF THE ACCOMPANYING DRAWINGS

For a better understanding of the invention, reference is made to the accompanying drawings, in which FIG. 1 is a schematic sectional view of a cooling tank with an upward passage for refrigerant according to the invention;

DESCRIPTION OF THE PREFERRED EMBODIMENT

Figure 2:
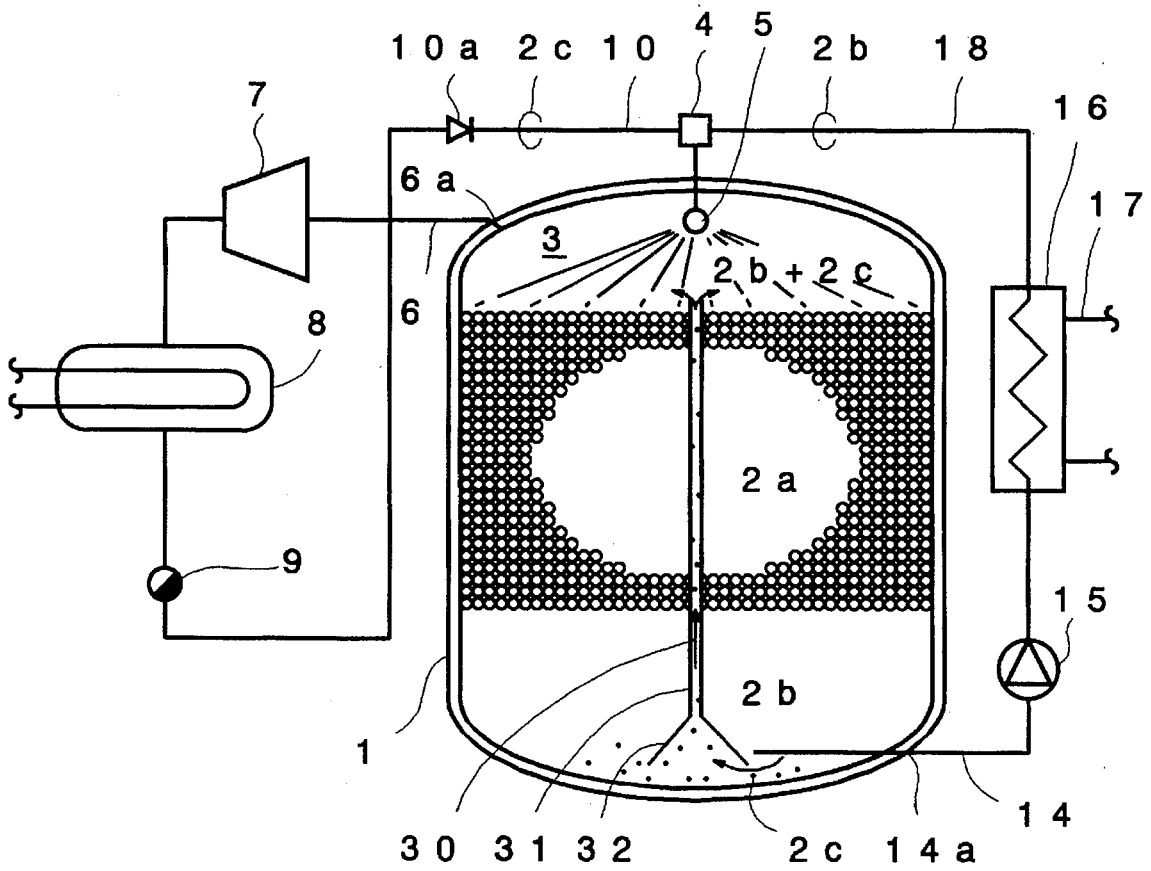
FIG. 2 is a schematic sectional view of an embodiment of the invention in which the lower end portion of the upward passage for refrigerant is expanded into a cone shape.

If refrigerant gas produced by the boiling of the settled refrigerant 2*c* does not enter the upward passage 30 but ascends along its outside, neither of the above-mentioned uprising stream and the drawing action of the refrigerant 2*c* will be generated. To avoid such situation, a cone-like expanded portion 32 can be formed at the lower end of the upright pipe 31 defining the passage 30, as shown in FIG. 2. The refrigerant gas generating at the cooling tank bottom is collected by such expanded portion 32 and positively guided into the upward passage 30 to produce the uprising stream in it. As a result, generation of the drawing action of the refrigerant 2*c* at the tank bottom will be ensured. Further, with the expanded portion 32, it is possible to prevent the refrigerant gas from entering into the cooling water circulating pump 15 by disposing the intake of the pump 15 above the expanded portion 32, as shown in FIG. 2. Thereby, the pump 15 can be protected against occurrence of water hammering and gas locking which are caused by the presence of refrigerant in it. The expanded portion 32 can be also used to make the upright pipe 31 self-supporting.

Figure 1:
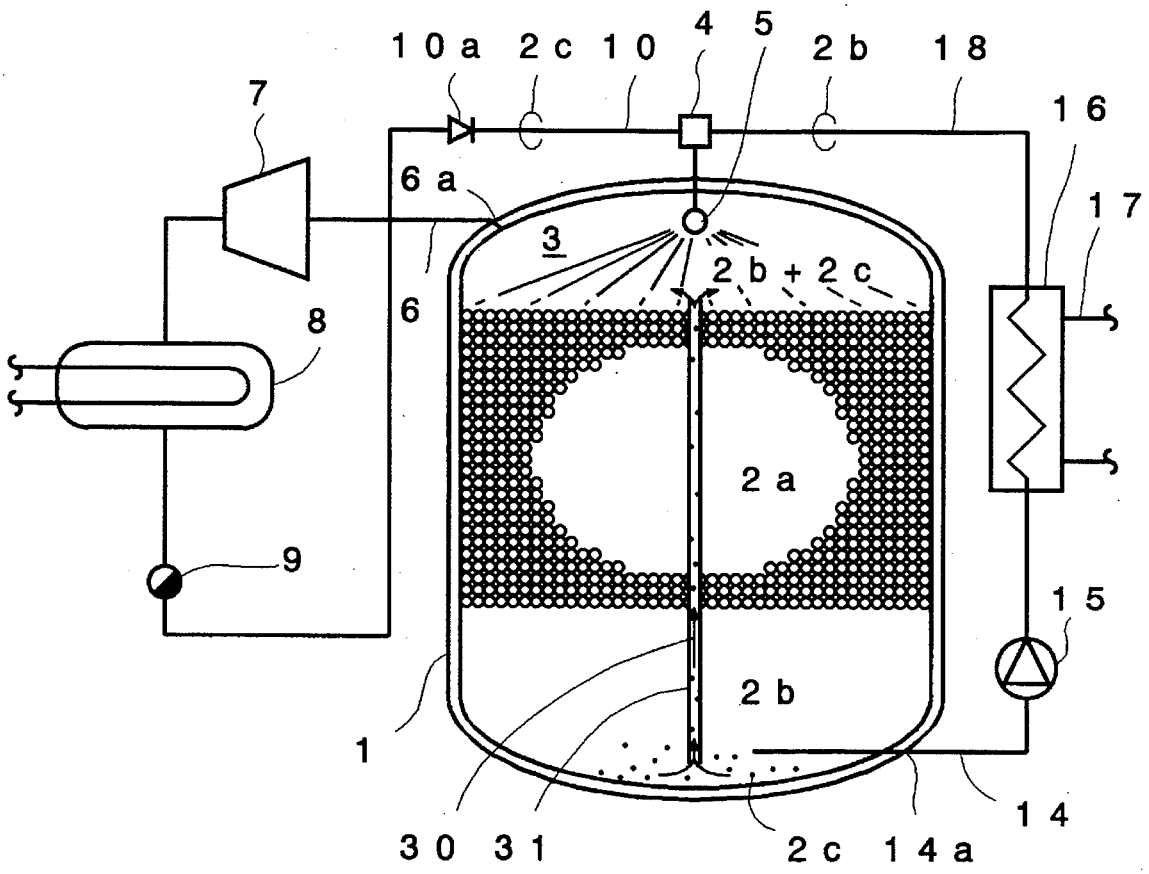

Although FIG. 1 shows application of the invention to an ice-making machine, the invention can be also applied to a chiller. The refrigerant evaporator of a regular chiller can be replaced with the direct-contact type cooling tank 1 having the upward passage 30 according to the invention, and the cost of the refrigerant evaporator can be saved. In addition, the direct-contact heat exchange may improve the performance of the chiller.

It may be noted here that an ice making system using a cooling tank with an upright pipe has been known, in which system refrigerant is brought in contact with water within the upright pipe (e.g., Japanese Patent Laying-open Publication No. 075948/1993). However, such known system uses the inside of the upright pipe as a major heat exchange space, and it is not concerned with the specific gravity of refrigerant, and furthermore it does not aim at either recovery of that refrigerant which has deviated from the refrigerative cycle or return of the recovered refrigerant back to the refrigerative cycle. On the other hand, with the cooling tank 1 of the invention, the major heat exchange space is the space 3 above the water surface, but not the inside of the upward passage 30. Besides, the purpose of the upward passage 30 in the invention is to recover refrigerant settling at the tank bottom and to return the recovered refrigerant back to the refrigerative cycle. Sometimes, heat exchange may take place in the upward passage 30 of the invention, but it is only for secondary purposes.

Figure 3:
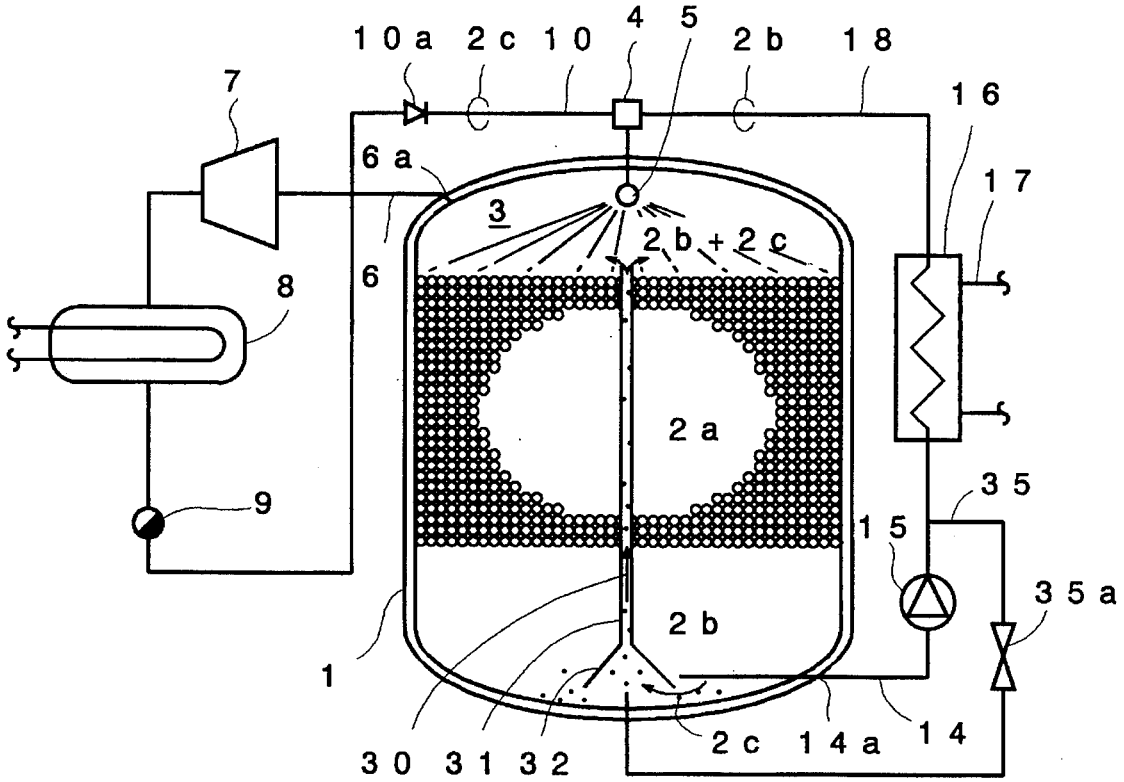
FIG. 3 is a schematic sectional view of a modification of the embodiment of FIG. 2, wherein a water conduit is added between the discharge side of a cooling water circulating pump and the bottom of the cooling tank, so as to return a part of the discharged cooling water to the tank bottom.

FIG. 3 shows another embodiment of the invention, in which an outside circulating pump 15 is connected to the cooling water outlet 14*a* of the cooling tank 1, and a water conduit 35 is provided between the discharge side of the circulating pump 15 and such portion of the bottom of the cooling tank 1 that faces the lower end of the upright pipe 31 forming the upward passage 30. In the embodiments of FIGS. 1 and 2, temporary reduction of pressure at the space 3 above water surface is necessary to initiate boiling of the refrigerant 2*c* settling at the tank bottom. In the embodiment of FIG. 3, however, the discharge water from the circulating pump 15 is led to the lower end opening of the upright pipe 31 so that an uprising stream can be induced in the upright pipe 31 by the discharge water flow from the pump 15. The settling refrigerant 2*c* is drawn into the upright pipe 31 by the thus induced uprising stream, and the refrigerant 2*c* becomes more easily evaporable as it ascends in the upright pipe 31 because the static water pressure decreases accordingly.

In short, initiation of the boiling of the settling refrigerant 2*c* can be expedited by using the discharge water flow of the circulating pump 15. Once the boiling is initiated, acceleration of the drawing action due to the uprising stream of the refrigerant gas takes place in the same manner as that in FIG. 1.

Figure 4:
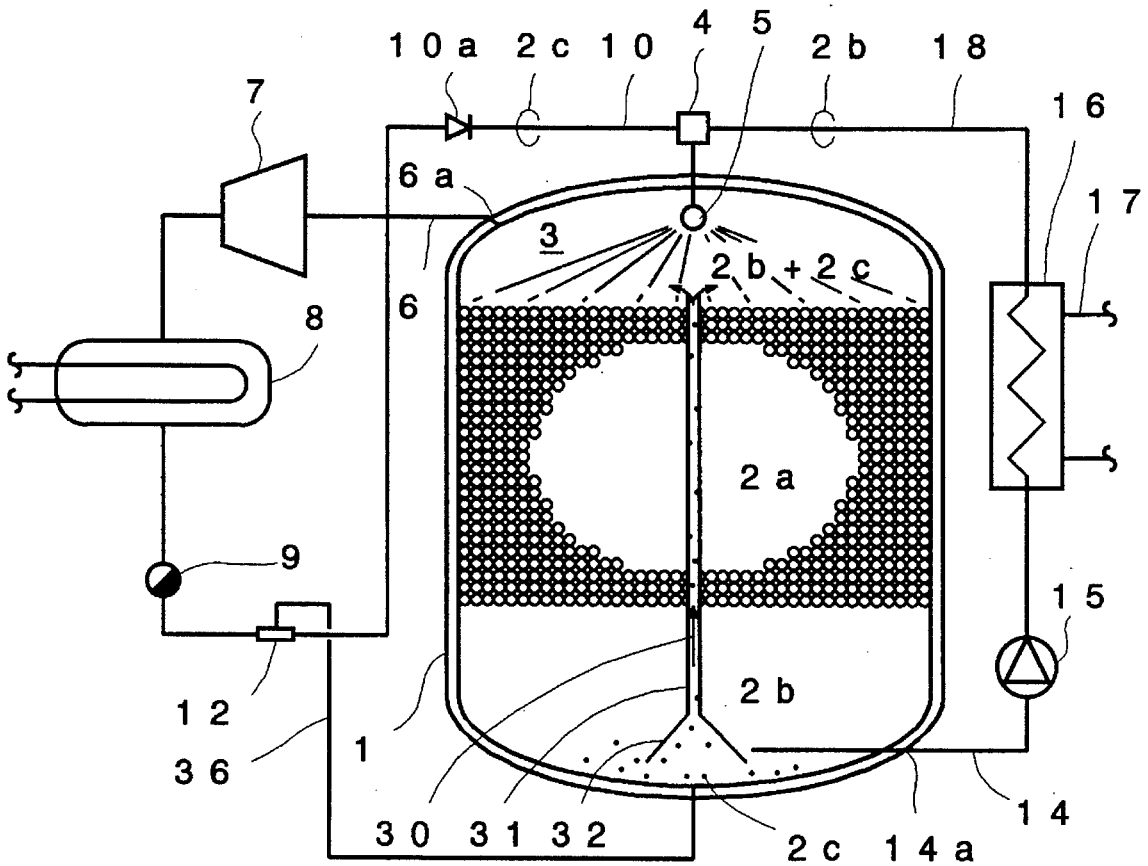
FIG. 4 is a schematic sectional view of a different modification of the embodiment of FIG. 2, wherein a flash gas bleeder is mounted on a refrigerant liquid pipe and the flash gas bleeder is connected to the bottom of the cooling tank through a flash gas conduit so that flash gas from such bleeder is fed to the tank bottom.

FIG. 4 shows another embodiment which produces uprising stream in the upward passage 30 by using flash gas that generates at the time of pressure reduction of refrigerant 2*c*. Refrigerant gas 2*c* inhaled by the compressor 7 through an extraction hole 6*a* of the cooling tank 1 is compressed and delivered to a condenser 8 for liquefaction and the liquefied refrigerant 2*c* is sent to the mixer 4 through the refrigerant liquid pipe 10. In the passage between the condenser 8 and the mixer 4, refrigerant 2*c* is subjected to pressure reduction by a gas trap 9 and the like, and a part of the liquid refrigerant 2*c* evaporates at the time of pressure reduction and becomes flash gas.

Figure 7:
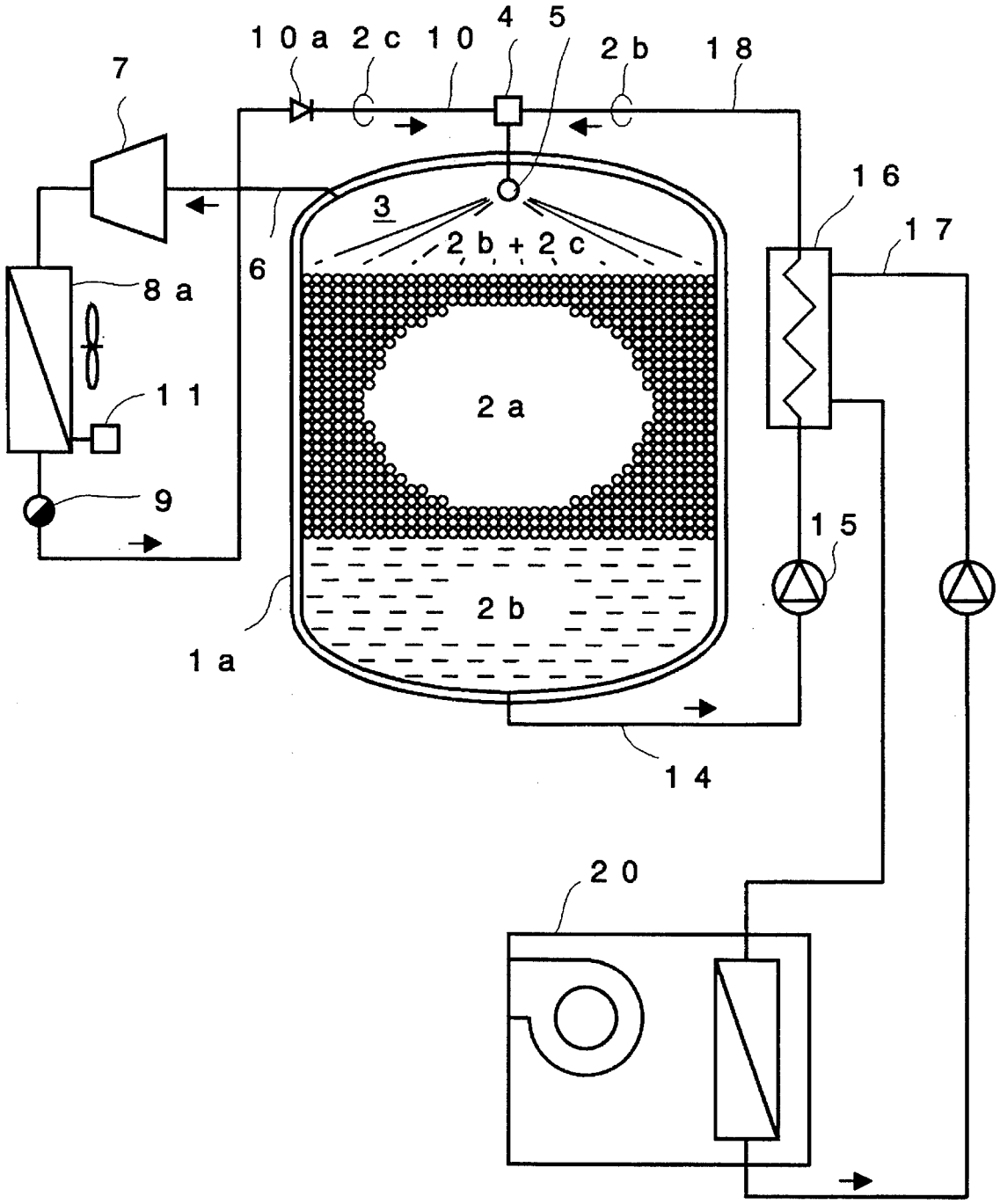
FIG. 7 PRIOR ART
FIG. 7 is a schematic sectional view of a water tank of prior art.

To separate the flash gas, a flash gas bleeder 12 is used in the example of FIG. 4, and a flash gas conduit 36 connects the flash gas bleeder 12 to that portion of the bottom of the cooling tank 1 which faces the lower end opening of the upright pipe 31. An uprising stream is induced in the upright pipe 31 by ascension of the flash gas which is delivered to the cooling tank 1. The thus induced uprising stream draws the settled refrigerant 2*c* at the cooling tank bottom into the upright pipe 31. In the upright pipe 31, the boiling of the refrigerant 2*c* is expedited as it ascends, because the static water pressure therein decreases accordingly. Once the boiling is initiated, acceleration of the drawing action due to the uprising stream takes place in the same manner as that in FIG. 3. In this embodiment, the condenser 8 is cooled by water, but it is possible to use an air cooled condenser 8*a* of FIG. 7 in the embodiment of FIG. 4.

Figure 5:
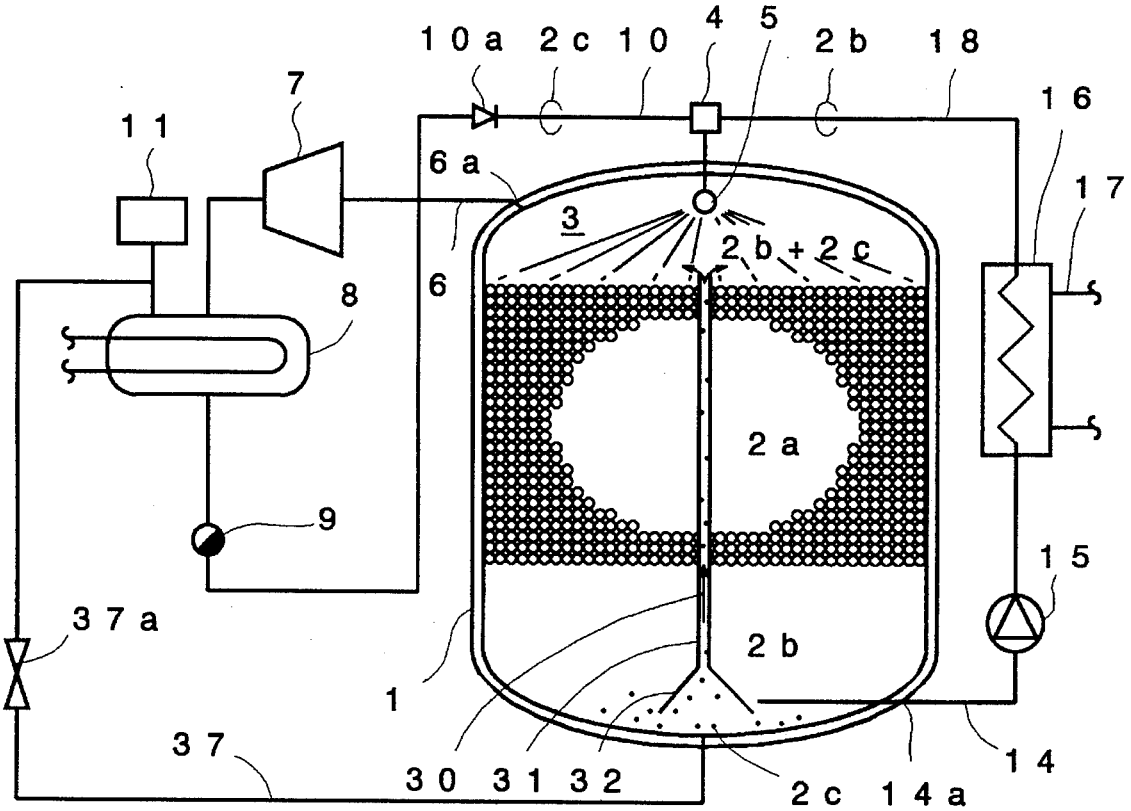
FIG. 5 is a schematic sectional view of a further modification of the embodiment of FIG. 2, wherein an air bleeder is mounted on the condenser and the air bleeder is connected to the bottom of the cooling tank through an uncondensed gas conduit so that uncondensed gas from the air bleeder is fed to the tank bottom.

FIG. 5 shows another modified cooling tank 1 which produces uprising stream in the upward passage 30 by using uncondensed gas, such as air, that is separable at the condenser 8 for liquefying refrigerant. In the case of refrigerative cycle using a high boiling point refrigerant, such as fluorinated pentane, the inside of the cooling tank 1 can be below atmospheric pressure and air can leak into the tank 1. Air is not easily condensable and tends to hamper liquefaction of refrigerant 2*c* in the condenser 8. An air bleeder 11 or uncondensable gas separator is commonly used to remove air generated in the condenser 8, but it is not economical to run continuously such air bleeder 11 or uncondensable gas separator. In the modification of FIG. 5, an uncondensed gas conduit 37 connects air outlet of the condenser 8 to that portion of the bottom of the cooling tank 1 which faces the lower end opening of the upright pipe 31, and a valve 37*a* is provided in the conduit 37 so that uncondensed gas accumulated in the condenser 8 may be sent to the cooling tank bottom from time to time.

The uncondensed gas from the condenser 8 is used to induce the above-mentioned uprising stream in the upright pipe 31. Such use of the uncondensed gas has merits in that it precludes accumulation of uncondensable gas in the condenser 8 and that it prevents deterioration of dissipation of condensing heat from the condenser 8.

Figure 6:
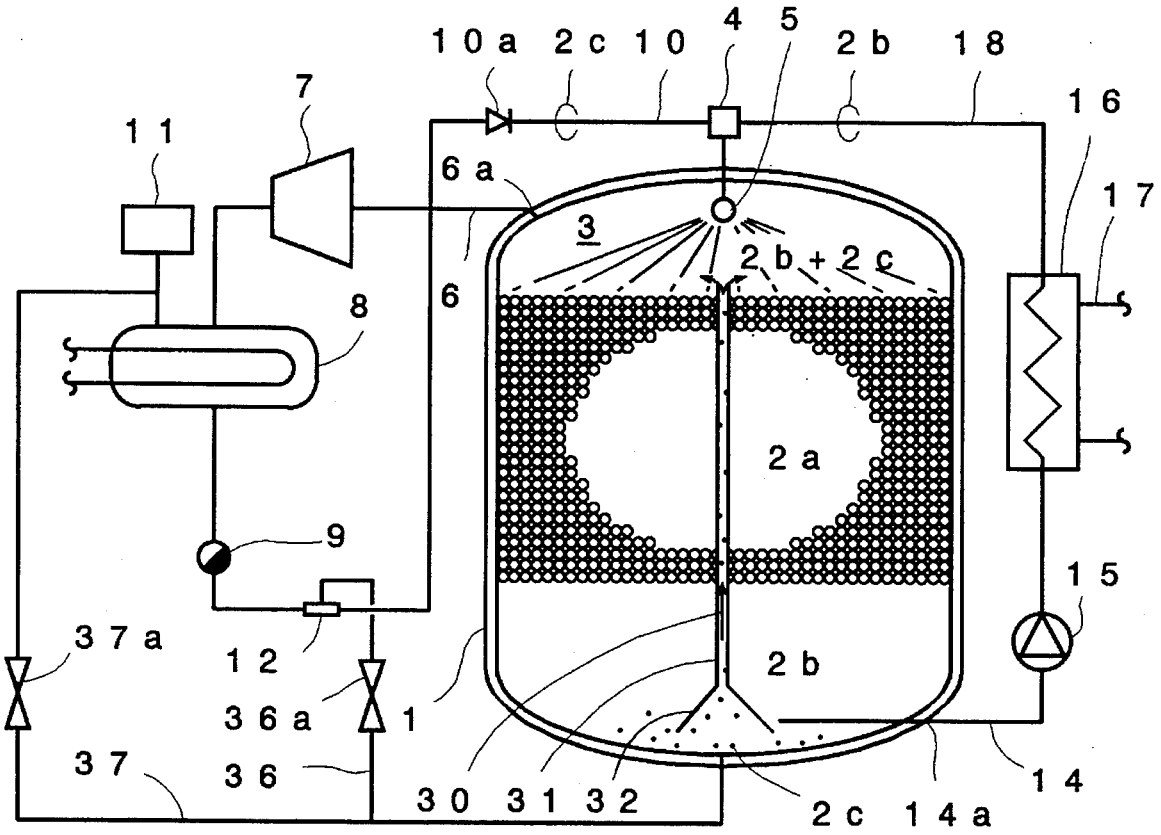
FIG. 6 is a schematic sectional view of a cooling tank which has both the flash gas conduit of FIG. 4 and the uncondensed gas conduit of FIG. 5.

FIG. 6 illustrates a further modification of the cooling tank 1 which induces uprising stream in the upward passage 30 by a combination of the use of flash gas in FIG. 4 and the use of uncondensed gas of FIG. 5. It is also possible to add the use of water flow from the circulating pump 15 of FIG. 3 into the modification of FIG. 6.

The invention has been described by referring to different embodiments which use the mixer 4. The recovery of settled refrigerant 2*c* by using the upward passage 30 of the invention, however, can be applied to any other cooling tank 1 which may not have the mixer 4, provided that refrigerant 2*c* is brought into contact with water 2*b* in the cooling tank 1.

As described in detail in the foregoing, the direct-contact type water cooling tank of the invention is to bring hardly-water-soluble refrigerant having a larger specific gravity than that of water into direct contact with water, and the cooling tank keeps pressure $P_t$ at a space above water surface therein below the saturation pressure $P_0$ of the refrigerant at water freezing point ($P_t \leqq P_0$), and the cooling tank has a refrigerant extraction hole for extracting gas-phase refrigerant, an outlet for drawing cooled water, and an upward refrigerant passage extending from the bottom of the tank to the water surface therein, the passage guiding ascension of that refrigerant which settles at the tank bottom to said space above the water surface. Whereby, the following outstanding effects are achieved.

(1) It prevents refrigerant from sleeping at the bottom of the cooling tank, facilitates return of settled refrigerant back to active refrigerative cycle, and keeps the performance of refrigerative cycle at a high level.

(2) Eliminating refrigerant settling, it prevents the cooling water circulating pump from cavitation due to inhaling of the settled refrigerant.

(3) It precludes uncondensable gas from accumulating in the refrigerant condenser and prevents deterioration of dissipation of condensation heat.

What is claimed is:

1. A cooling tank for cooling water by bringing water in direct contact with hardly-water-soluble refrigerant having a larger specific gravity than that of water, comprising a heat insulating tank, an inside space above water surface in the tank, pressure $P_t$ of said space being kept below the saturation pressure $P_0$ of the refrigerant at water freezing point ($P_t \leqq P_0$), a refrigerant extraction hole for extracting gas-phase refrigerant, an outlet for drawing cooled water, and an upward refrigerant passage extending from the bottom of the tank to the water surface therein, said passage guiding ascension of that refrigerant which settles at the tank bottom to said space above the water surface.

2. A cooling tank as set forth in claim 1, wherein said upward refrigerant passage is formed of an upright pipe having a lower end opening facing the tank bottom and a top end opening located in the vicinity of water surface in the tank.

3. A cooling tank as set forth in claim 1, wherein the refrigerant consists essentially of perfluoropentane and/or fluorohydropentane.

4. A cooling tank as set forth in claim 2, wherein the lower end opening of said upright pipe expands as the pipe extends toward the tank bottom.

5. A cooling tank as set forth in claim 2, wherein a circulating pump is connected to the outlet for discharging the cooled water to the outside of the cooling tank, and a water conduit is connected between the discharge side of the circulating pump and that portion of the water tank bottom which faces the lower end of the upright pipe.

6. A cooling tank as set forth in claim 2, wherein the gas-phase refrigerant extracted through the refrigerant extraction hole is compressed and liquefied and returned to the cooling tank through a refrigerant liquid pipe having a flash gas bleeder, and a flash gas conduit is connected between the flash gas bleeder and that portion of the water tank bottom which faces the lower end of the upright pipe.

7. A cooling tank as set forth in claim 2, wherein an air bleeder is provided to bleed uncondensable gas from the liquefied refrigerant, and an uncondensed gas conduit is connected between the inlet side of the air bleeder and that portion of the water tank bottom which faces the lower end of the upright pipe.

8. A cooling tank as set forth in claim 4, wherein a circulating pump is connected to the outlet for discharging the cooled water to the outside of the cooling tank, and a water conduit is connected between the discharge side of the circulating pump and that portion of the water tank bottom which faces the expanded lower end of the upright pipe.

9. A cooling tank as set forth in claim 4, wherein the gas-phase refrigerant extracted through the refrigerant extraction hole is compressed and liquefied and returned to the cooling tank through a refrigerant liquid pipe having a flash gas bleeder, and a flash gas conduit is connected between the flash gas bleeder and that portion of the water tank bottom which faces the expanded lower end of the upright pipe.

10. A cooling tank as set forth in claim 4, wherein an air bleeder is provided to bleed uncondensable gas from the liquefied refrigerant, and an uncondensed gas conduit is connected between the inlet side of the air bleeder and that portion of the water tank bottom which faces the expanded lower end of the upright pipe.

* * * * *